United States Patent [19]

Fujiwara et al.

[11] 4,209,268

[45] Jun. 24, 1980

[54] TAIL PACKING FOR A SLURRY PRESSURIZED SHIELD

[75] Inventors: Toshio Fujiwara, Shiki; Junji Sakimoto, Kiyose; Hisaya Yoshioka, Kawaguchi, all of Japan

[73] Assignee: Ohbayashi-Gumi, Ltd., Osaka, Japan

[21] Appl. No.: 879,390

[22] Filed: Feb. 21, 1978

[51] Int. Cl.[2] ..... E01G 5/16

[52] U.S. Cl. ..... 405/147; 277/138

[58] Field of Search ..... 277/530, DIG. 2, 138; 405/146, 147

[56] References Cited

U.S. PATENT DOCUMENTS

| | | | |
|---|---|---|---|
| 2,798,005 | 7/1957 | Love | 277/DIG. 6 |
| 2,891,921 | 6/1959 | Kumnick et al. | 277/DIG. 6 |
| 2,998,991 | 9/1961 | Spencer | 277/53 |
| 3,013,824 | 12/1961 | Wilson | 277/53 |
| 4,057,971 | 11/1977 | Yamazaki | 405/147 |
| 4,139,989 | 2/1979 | Jones | 405/147 |

*Primary Examiner*—Robert I. Smith

*Attorney, Agent, or Firm*—Fleit & Jacobson

[57] ABSTRACT

A tail packing for a slurry pressurized shield is provided, comprising outer layers of strings and a filter element layer between the outer layers. The outer layers are composed of a number of strings densely arranged in a juxtaposed relation.

12 Claims, 1 Drawing Figure

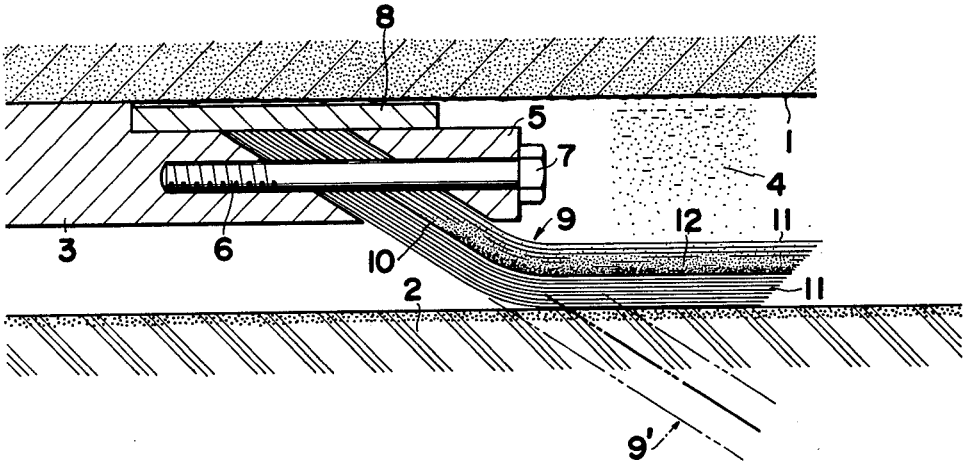
8
5
7
1
4
9
12
11
3
6
10
2
11
9'

TAIL PACKING FOR A SLURRY PRESSURIZED SHIELD

BACKGROUND OF THE INVENTION

The present invention relates to a tail packing for the shield construction method, and more particularly to an improvement of the tail packing for the slurry pressurized shield method.

Recently in urban communities, due to necessity of securing surface road transportation, prevention of pulbic nuisance such as from vibration and noise, crossings of existing structures and difficulty of construction posed by close proximity of other works, construction conditions have changed drastically, accelerating development of the shield method replacing the conventional open-cut method.

The shield method was orginally contrived and developed as a highly technical tunnelling method to cope with the worst type of ground such as under rivers and ocean bed.

The shield construction is a tunnel boring method in which a steel tubular frame is used to sustain the earth pressure while the earth is excavated. The tunnel is constructed by advancing the shield as construction progresses. Namely, in the shield construction, the earth is excavated for the length equivalent to the width of one ring or piece of segment, which is a concrete block used as tunnel lining and serves to counter-balance reaction by shield jacks, and the shield machine is advanced for a distance equivalent to a single ring of the segment. Then, the segments are assembled at the tail end of the shield machine, and backfill grouting operations are then carried out, in which the space between segments and the natural ground is grouted with mortar or concrete. After the backfill grouting is carried out, hauling out of dross (namely, excavated soil) and hauling in of additional segments, etc. are performed.

The shield method has such advantages that the surface above is not affected during construction since most of the work is performed underground, that construction can be accomplished even where buried utility lines such as underground cables are numerous since the construction deep under the ground is possible, and that construction nuisance such as noise and vibration is less compared to the other tunnel construction method.

However, in recent times, in view of safety and sureness of natural ground stabilization, prevention of settlement, speed-up of construction and reduction of labor, efforts have been made to achieve a new construction technique, resulting in the development of the slurry shield or slurry pressurized shield, which will be described.

Particularly, it has been found that the conventional shield method has faced with the serious problem to be solved of prevention of settlement.

One of the most serious problems inherent to the shield method is settlement or land subsidence due to the collapse at the tail void of the shield machine. This settlement is induced by a collapse of the earth to tail void formed between the segment and the earth after the shield machine is advanced.

In order to prevent the collapse of the earth at the tail void, backfill material such as mortar is grouted. However, a tail packing of the shield, which is not only important for preventing a reverse flow of the backfill and permitting an instant backfill grouting but also is necessary for prevention of slurry leakage in case of a slurry pressurized shield method, did not have a desired shield performance or sealing effect. Lack of desired shield performance in the tail packing causes a hindrance in the instant backfill grouting operation, resulting in the aforementioned serious problem of settlement. In particular, the conventional tailpacking was not effective for sealing when deformed segments are used or when there was an unevenness between the segments. Thus, three involved a serious problem that instant filling of backfill material was hampered.

Attempts have been made so as to improve the conventional tail packing to permit a prevention of leakage of the backfill material into the shielded area.

A brush-type tail seal packing was developed to meet with the above requirement, as described in Japanese Utility Model Application No. 49-58618, laid open for public inspection on Dec. 6, 1975 under No. 50-147431. The brush-type tail packing is composed of a number of nylon monofilaments or the like which are arranged in close proximity and dense manner to form a "brush" shape. It has been found that the brush-type tail seal packing permits a desirable shield effect in the aforementioned shield construction method. However, the conventional brush-type tail seal packing is not available in the slurry pressurized shield method.

The slurry pressurized shield is a tunnelling method characterized by the use of slurry for the stabilization of the area to be cut by the excavator and which simultaneously enables transport of dross as a fluid. The synopsis of this method is as follows: a separator wall is installed at the rear of the rotary cutter fixed on the nose of the shield machine; the space between the separator wall and the cutter face is filled with bentonite particles and the earth retaining effect is achieved by formation of a mud-cake caused by activity of bentonite; the earth-pressure and the ground water pressure at the cutting area is restrained by the pressurized slurry and the cutter-face; underwater excavation is performed by the rotary cutter and the dross piped out together with the slurry.

By this method, as the slurry is constantly circulated to perform the excavation, a control pump and pipeline is necessary to maintain the pre-determined slurry pressure at the cutting area.

In the slurry pressurized shield method, since the stabilization of the facing, namely prevention of collapse of the facing, is effected by the slurry pressure, the slurry leakage causes a lowering of the slurry pressure, and results in a collapse of the facing. The pressurized slurry is fed along the outer surface of the shield to the rear side of the shield, and therefore, it is necessary to completely seal the slurry and to prevent the slurry from leaking out of the tail packing.

This is the reason why the aforementioned conventional brush-type tail packing is not available for prevention of the slurry leakage in the slurry pressurized shield method, though the same has an effect to seal the backfill material as mortar.

In addition to the above, the conventional brush-type tail packing is lacking in the necessary stiffness, durability, and endurance against pressure.

SUMMARY OF THE INVENTION

Accordingly, an object of the present invention is to provide an improved tail packing available for the slurry pressurized shield method.

A further object of the present invention is to provide an improved tail packing which permits a complete shield effect even when the segments are deformed or of unevenness.

Another object of the present invention is to provide a tail packing which has a characteristic of durability.

Another object of the present invention is to provide a tail packing which prevents a leakage of slurry as well as of backfill material.

The present invention has been accomplished based upon the finding that a mud-cake formed on a filter material by a passage of slurry through the filter element has a water-stop characteristic.

According to the present invention, there is provided a tail packing for the slurry pressurized shield, comprising outer layers of strings densely arranged in a substantially juxtaposed relation and a filter element layer between the outer layers. The structure of the tail packing permits to form a mud-cake on the filter element as slurry passes through the filter element, thereby presenting a water-stop effect.

Other objects and features of the present invention will become apparent from the detailed description of a preferred embodiment thereof, which will be read with reference to the accompanying drawing.

BRIEF DESCRIPTION OF THE DRAWING

The drawing is a sectioned view of a tail packing in accordance with the present invention.

DETAILED DESCRIPTION OF THE INVENTION

Referring to the drawing in which reference numeral 1 represents the earth excavated by a shield machine (not shown), 2 represents a segment liner, 3 represents a tail plate of the shield machine, and 4 represents a slurry fed to the tail of the shield machine, a clamping device 5 including a foundation bolt 6, nut 7 and a metal plate 8 is attached to the tailend of the tail plate 3. The clamping device 5 clamps a brush-type tail packing 9 in an inclined manner as illustrated. The tail packing 9, which is inclined in respect of the axis of the bolt 6 and extends in a straight manner as illustrated by 9', is closely contacted with the outer surface of the segmental liner 2. Thus, the tail packing is bent or curved at the position where the tail packing contacts the segmental liner 2.

The tail packing 9 of the present invention includes a filter material 10 between layers of filaments 11. The filter element 10 is made of woven or non-woven fabric or any other desired material such as open cell type synthetic resin. The woven fabric may be made of natural fibrous material or man-made fiber.

The layers of filaments 11 are composed of a number of nylon monofilaments each having a diameter of about 1.0 mm with or without an adhesion of chalk or carborundum on the surface of each monofilament. Chalk or carborundum attached on the surface of the nylon monofilaments presents a further durability. Alternately, the layers of filaments 11 may be made of any other synthetic resin materials with solid particles mixed therewith or strings of metals.

Slurry, which leaks through the filter element at the initial stage, stops leaking since the slurry contains a number of solid particles which clog the filter element, thereby forming a dense and thick layer of mud-cake 12 on the filter element. Thus, a water-stop effect is given to the packing 9.

It has been found in model experiments that the packing 9 with a mud-cake 12 formed therein withstands completely enough the slurry pressure of $5kg/cm^2$. Further, it was found that the packing of the present invention presented a desired shield effect when there was a deformed segment as deep as 10 mm or unevenness of 10 mm between segmental liners. Namely, the packing 9 met with the shielding requirement even when there was a 10 mm deformation or unevenness at the outer surface of the segment. Accordingly, cracks, which are sometimes formed in the mud-cake when the packing 9 of the shield macine is advanced further along the deformed or uneven surface of the segment, are immediately filled with solid particles contained in the slurry to thereby maintain the necessary water-stop effect.

It is not always that the mud-cake formed on the filter element 10 can stop the flowing or leakage of any slurry whatever the concentration thereof may be. According to the model experiments, a critical specific gravity of the slurry which can be stopped and shielded by the mud-cake was about 1.03. It was found that slurry of higher specific gravity permitted to form a thicker and denser mud-cake, and that slurry of lower specific gravity formed a thinner and coarse mud-cake.

As described above, the tail packing of the present invention has a filter element layer at the middle portion of the known brushtype tail packing such that the filter element layer is disposed between the outer layers 11 of strings. Thus, the combination of the brushlike outer layers, the middle filter element 10 and the mud-cake formed on the filterelement is effective for shielding the slurry 4. Further, since the tail packing 9 and the mud-cake 12 formed on the filter element are completely adapted or fitted for the shape of the segment, the water-stop effect required in the slurry pressurized shield can be ensured. Further, since the filter element is disposed between the strings layer 11, the outer layers 11 protect the filter element 10 from being worn out and from friction with the segmental liner.

What is claimed is:

1. A tail packing for sealing a gap between a segment liner and a tail plate of a slurry pressurized shield tunnel machine, said tail packing comprising:

an annulus formed of a plurality of juxtaposed layers of strings attachable to a tail plate of a shield tunnel machine in such manner that the filaments extend inwardly from the tail plate at an angle skew to the axis of the tail plate and at least one of the layers engages and lays against an outer periphery of a segment liner encompassed by the tail plate; and a filter element of toroidal configuration positioned within said juxtaposed layers of strings and extending inwardly towards the segment liner from the attachment of the strings to the tail plate, said at least one layer being positioned between the filter element and the segment liner, the arrangement of the filter element being such that, when slurry initially passes through the tail packing, a mud-cake is formed on said filter element to seal a gap between the tail plate and segment liner thereby preventing continued passage of slurry through the tail packing.

2. The tail packing in accordance with claim 1, in which said filter element is made of a woven fabric.

3. The tail packing in accordance with claim 1, in which said filter element is made of a non-woven fabric.

4. The tail packing in accordance with claim 1, in which said filter element is made of an open cell type synthetic resin.

5. The tail packing in accordance with claim 1, in which said outer layers of strings are made of nylon monofilaments.

6. The tail packing in accordance with claim 5, in which said strings of nylon monofilament are coated with chalk.

7. The tail packing in accordance with claim 5, in which said strings of nylon monofilament are coated with carborundum.

8. The tail packing in accordance with claim 2, in which said outer layers of strings are made of nylon monofilaments.

9. The tail packing in accordance with claim 8, in which said strings of nylon monofilament are coated with chalk.

10. The tail packing in accordance with claim 8, in which said strings of nylon monofilament are coated with carborundum.

11. The tail packing according to claim 8, in which each of said nylon monofilaments has a diameter of about 1.0 mm.

12. In a slurry pressurized shield tunnel machine having a tail plate for encompassing a segment liner, the improvement comprising a tail packing for closing an annular gap between the tail plate and the segment liner, said tail packing comprising:

an annulus formed of a plurality of juxtaposed layers of strings attached at one end to the tail plate and extending inwardly towards and into contact with the segment liner in such manner that at least one layer of the strings contacts and lays against the segment liner; and a filter element of toroidal configuration positioned within said juxtaposed layers of strings and extending inwardly from the attachment of the strings to the tail plate, the filter element being spaced from the segment liner by said at least one layer of strings in such manner that, when slurry initially passes through the tail packing, a mud-cake is formed on said filter element to seal a gap between the tail plate and segment liner thereby preventing continued passage of slurry through the tail packing.

* * * * *